US006071458A

United States Patent [19]

Mossi

[11] Patent Number: 6,071,458

[45] Date of Patent: Jun. 6, 2000

[54] SYSTEM FOR SHAPING THE SURFACE OF PRE-CAST CONCRETE PANELS

[75] Inventor: Michael Mossi, Avondale, Ariz.

[73] Assignee: Port-O-Wall Systems, LLC, Sonoma, Calif.

[21] Appl. No.: 08/885,023

[22] Filed: Jun. 30, 1997

[51] Int. Cl.[7] ..... B28B 3/12

[52] U.S. Cl. ..... 264/294; 264/31; 264/33; 264/35; 264/296; 264/310; 264/333; 425/363; 425/374; 425/470; 425/471; 425/472

[58] Field of Search ..... 264/333, 310, 264/293, 294, 296, 163, 162, 31, 33, 35; 426/363, 374, 470, 471, 472

[56] References Cited

U.S. PATENT DOCUMENTS

| | | | |
|---|---|---|---|
| Re. 27,109 | 3/1971 | Videen . | |
| 3,775,529 | 11/1973 | Steenson . | |
| 4,028,036 | 6/1977 | Farfor | 425/374 |
| 4,186,166 | 1/1980 | Hight, Jr. | 264/139 |
| 4,271,111 | 6/1981 | Sheber | 264/71 |
| 4,298,555 | 11/1981 | Weltmer | 264/31 |
| 4,496,504 | 1/1985 | Steenson et al. | 264/69 |
| 5,133,915 | 7/1992 | Metten et al. | 264/162 |
| 5,435,951 | 7/1995 | Toncelli | 264/69 |

*Primary Examiner*—Karen Aftergut

[57] ABSTRACT

The present invention generally relates to a system for manufacturing horizontally precast panels of moldable material which panels require shaped surface patterns. More particularly, the invention relates to a system for manufacturing horizontally precast concrete panels formed of concrete, for use in vertical wall systems, with one or more shaped surfaces.

5 Claims, 5 Drawing Sheets

SYSTEM FOR SHAPING THE SURFACE OF PRE-CAST CONCRETE PANELS

BACKGROUND OF THE INVENTION

It has been previously known to use prefabricated concrete panels to construct concrete wall systems for use in highway noise walls, retaining walls and other similar applications. An example of such wall systems is illustrated in U.S. Pat. No. 4,290,246 ('246) issued Sep. 1981.

Such walls have been manufactured by using rectangular steel casting forms positioned on a flat concrete casting slab. Wet concrete is poured into the casting forms. When the concrete hardens, the forms are removed, leaving finished rectangular concrete panels. The panels can then be assembled into a multipanel wall as shown, for example, in the '246 patent.

Such panels can be readily formed with a pattern on one side by employing so-called "form liners", which are rubbery semi-rigid sheets into which the desired pattern has been molded. These form liners are laid in the bottoms of the rectangular casting forms, and wet concrete poured into the forms on top of the form liners. Upon hardening, the bottom sides of the concrete panels conform to the pattern of the form liners. In some applications (such as those requiring patterns on both sides of the panels), it is desired to form a pattern on the topsides of the panels.

Where the pattern desired on the topside consists of vertical grooves, a rolling pin arrangement may be satisfactory. For example, in one arrangement, the rolling pin consists of a cylindrical 3-inch diameter stainless steel shaft with multiple stainless steel discs mounted on the shaft with setscrews. For an eight-foot wide casting form, the shaft of the rolling pin is 9 or 9½ feet long. The operator rests the ends of the rolling pin shaft on the sidewalls of the form, and then rolls the pin across the surface of the wet concrete to form vertical grooves. The difference in diameters of the shaft and discs thus govern the groove depths. The disc widths and cross section are governed by the width and cross sections of the discs; and the groove spacing is governed by the spacing of the discs on the cylinder shaft.

While the rolling pin system may be satisfactory for patterns with shallow grooves, it has proven unsatisfactory where relatively deep grooves (e.g. 1½ inches deep) are required. In such applications, if the roller is used while the concrete is very wet, the wet concrete flows back into the grooves. Alternatively, if the roller is applied later, after the wet concrete partially hardens, the roller does not cut deep enough into the concrete surface. Multiple passes at different stages do not solve the problem.

SUMMARY OF THE INVENTION

The present invention concerns a system for manufacturing a precast panel of moldable material by casting the panel in a horizontal casting form, and forming a pattern on the top surface of the panel with a motorized roller.

The roller has an elongate shaft with a plurality of forming discs spaced along its length for forming alternating ridges and grooves in the panel surface. The roller is mounted with the ends of the shaft resting on the lateral rails of the casting form. Elongate arms are mounted on each end of the roller shaft.

A hydraulic drive system is coupled to one end of the roller shaft to drive the motor in rotation about its longitudinal axis. The rotation of the roller pulls the roller along the surface of the panel, and simultaneously cuts grooves into the surface of the wet concrete. In operation, a first pass is made when the concrete is freshly poured. During this first pass, workers pull back on the elongate arms to retard the forward progress of the roller through the concrete, causing the roller to spin in the concrete to increase the cutting action of the roller. A second pass is made following the end of the first pass, again with the forward roller progress retarded to cause the roller to spin in the concrete. The concrete is then allowed to partially harden for a period of time, but not long enough to prevent the concrete from being further worked. Then a third pass is made with the progress of the roller being retarded even further to prolong the time that the concrete is exposed to the spinning roller, thereby troweling the surface of the wet concrete to obtain a smooth, high quality finish.

DESCRIPTION OF THE PREFERRED EMBODIMENT

Figure 1:
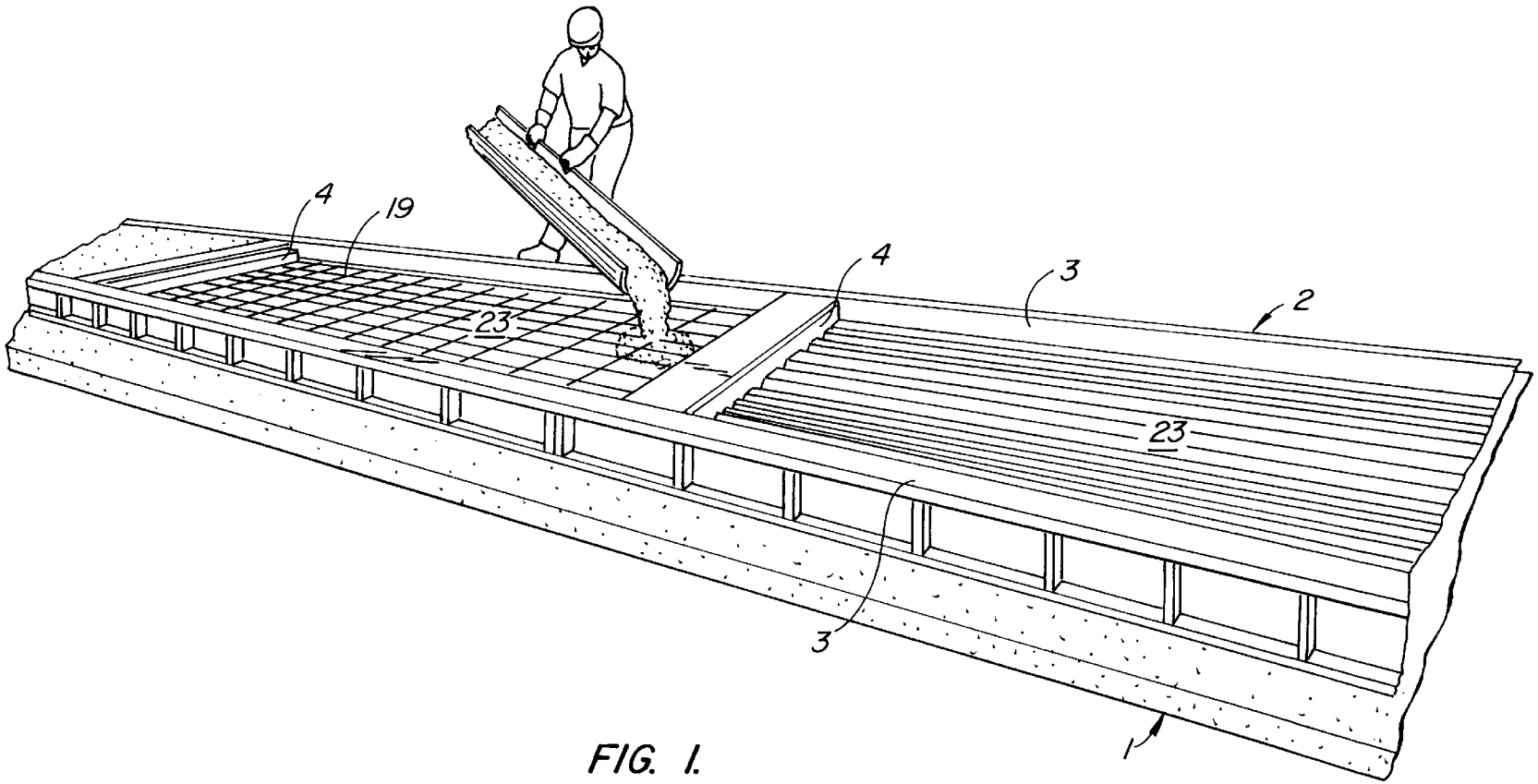
FIG. 1 is a perspective view of a casting bed and casting forms showing panels being manufactured according to the present invention.

Referring to the drawings, FIG. 1 shows a concrete casting bed 1 supporting a steel casting form 2. The casting form 2 consists of two spaced steel side rails 3 and multiple steel cross members 4, forming multiple rectangular casting compartments 23. The side rails are spaced approximately 8 feet from one another. The cross members 4 are variably spaced depending upon the desired length (height) of the finished panels. The side rails 3 and cross members 4 are detachable from one another.

Figure 2:
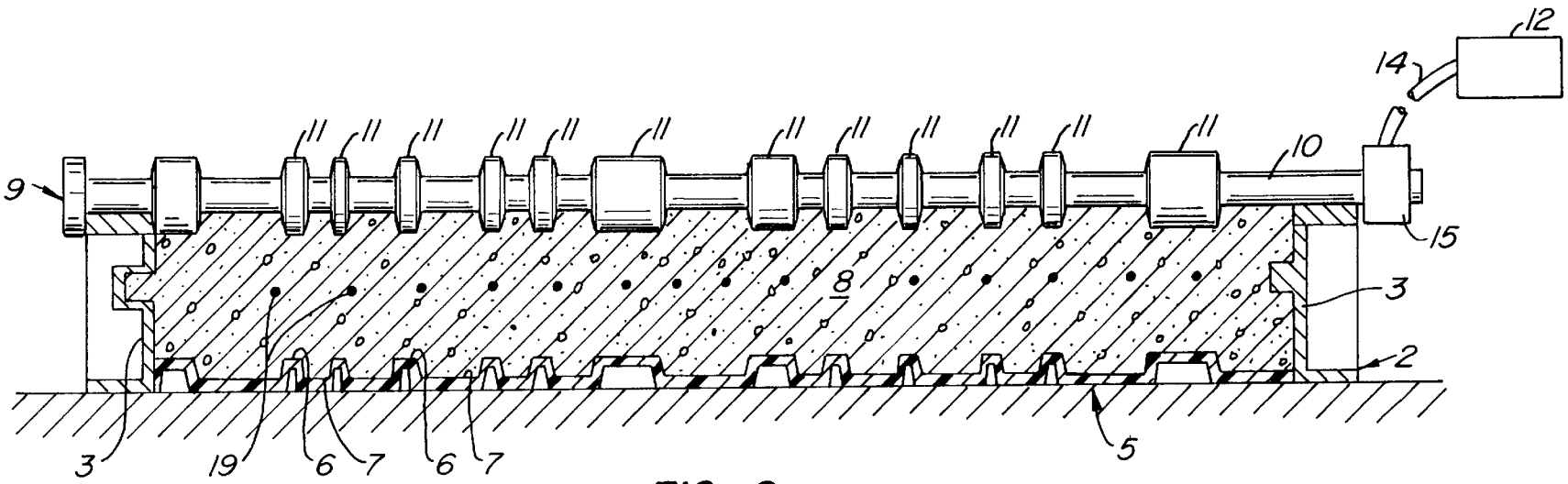
FIG. 2 is an end view in partial cross section showing the system of the present invention.

FIG. 2 shows form liner 5 positioned in the bottom of the casting form 2. The form liner 5 is constructed of a flexible, semi-rigid material with alternating ridges 6 and grooves 7 according to the pattern desired on the bottom surface of a panel. Wet concrete 8 fills the form 2. Rebar 19 is located in the body of the concrete 8 for reinforcement.

Stainless steel roller 9 has an elongate 3-inch diameter cylindrical shaft 10 approximately 9 feet long. The roller 9 has a plurality of stainless steel discs 11 mounted on the shaft 10 with setscrews (not shown). Each disc 11 is 6 inches in diameter, with a ¼ inch taper from the circumference to the center opening. The ends of the roller shaft 10 rest on the upper surfaces of the side rails 3. The discs 11 impart a shaped forming surface to the roller 9. The discs 11 vary in width from one to five and one-half inches and are spaced two to seven inches apart. Thus, the surface of the roller 9 provides a ridged forming surface consisting of multiple ridges 11 having generally rectangular cross section, variable width, variable spacing and uniform depth.

A hydraulic machine 12, manufactured by Dreco Corporation, has an 11 horsepower motor which drives a pump that forces hydraulic fluid through tube 14 into housing 15 where the hydraulic fluid flow is converted to rotational force, delivering rotational force to roller shaft 10. The hydraulic machine 12 is suited to drive the roller 9 at variable speeds such as, for example, 50 to 500 rpm, in both forward and reverse directions.

Figure 4:
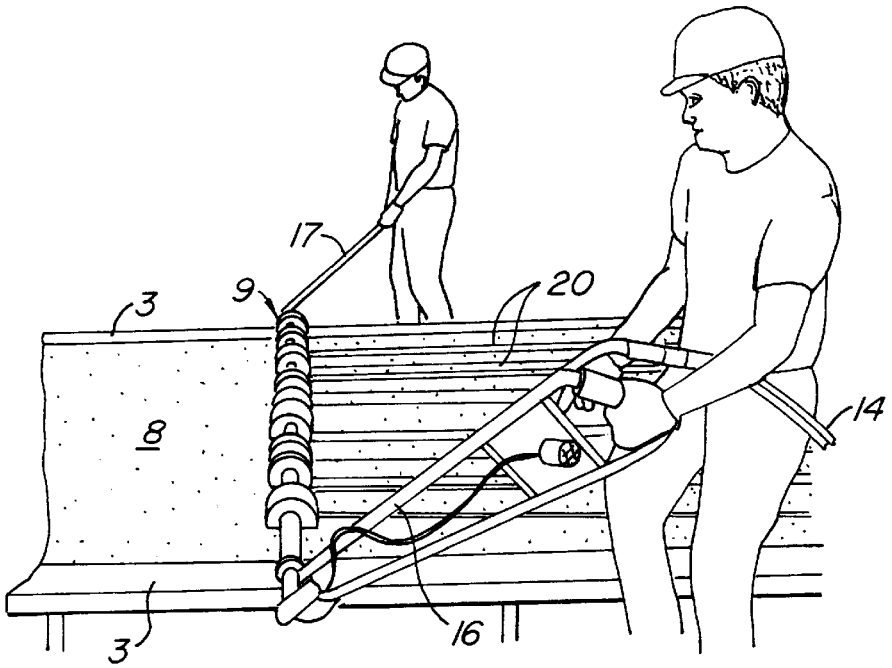
FIG. 4 is a side perspective view of the system of FIGS. 2 and 3, illustrating its operation with workers retarding the progress of the roller by pulling back on the roller arms.

As shown in FIG. 4, a first elongate handle 16 is rotatably attached to one end of shaft 10. A second elongate handle 17 is rotatably attached to the other end of shaft 10 at housing 18.

Figure 7:
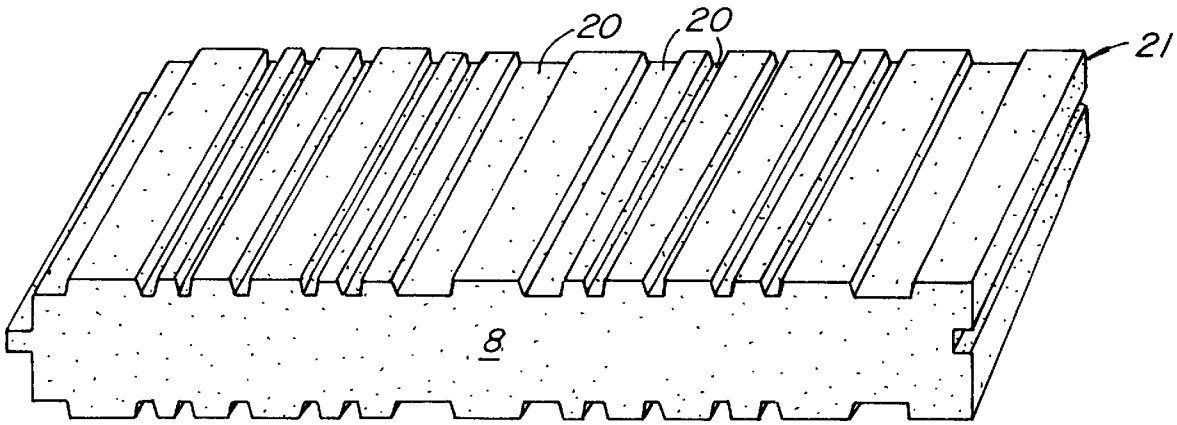
FIG. 7 is a precast concrete panel formed according to the present invention.
Figure 3:
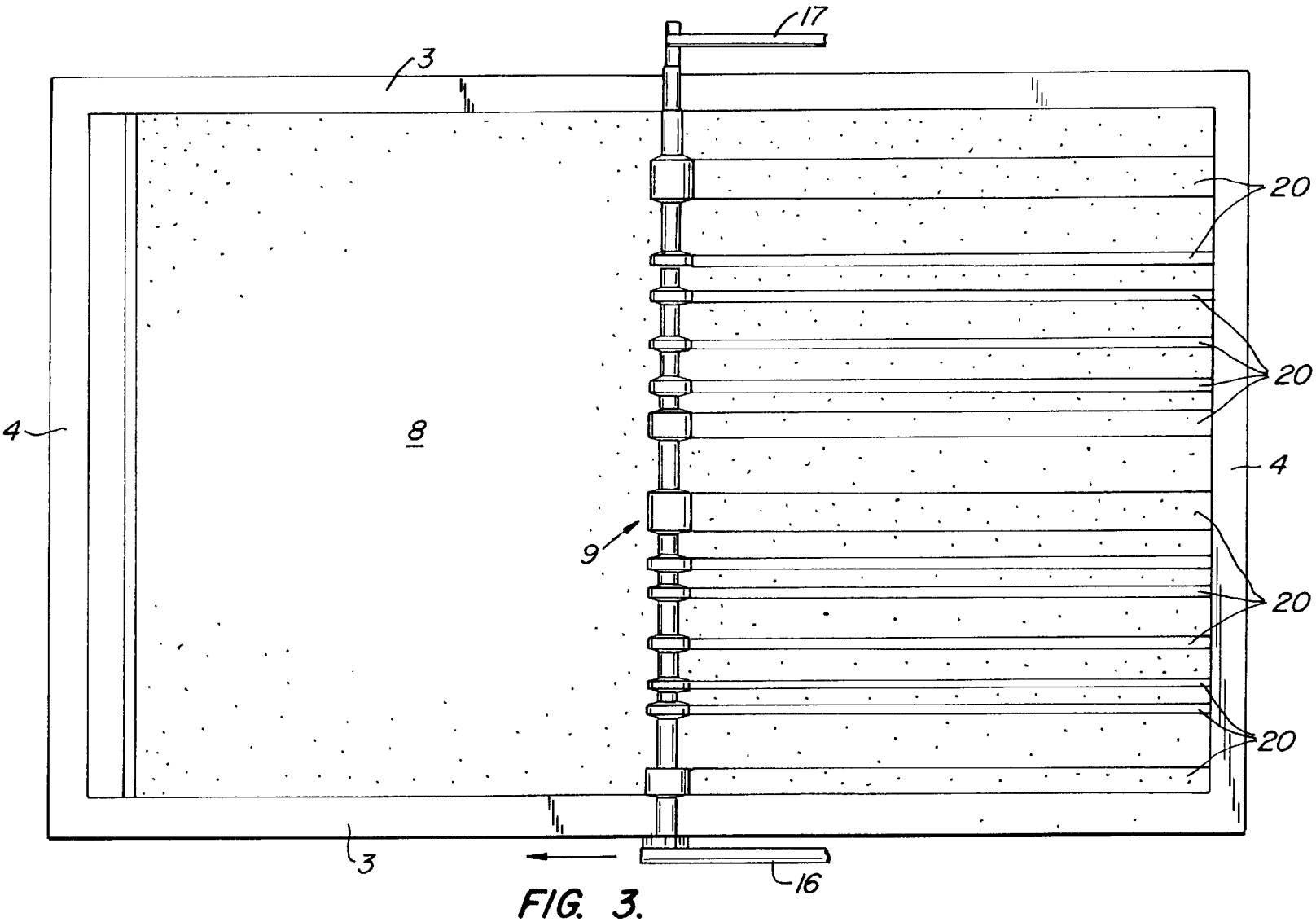
FIG. 3 is a plan view of the system shown in FIG. 2.
Figure 5:
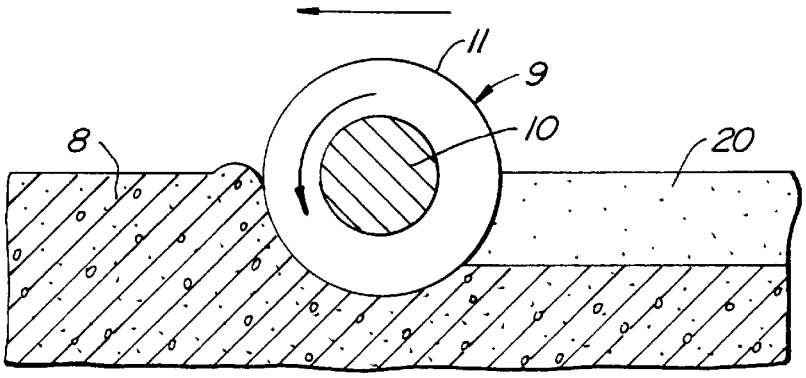
FIG. 5 is a cross sectional view of the system of FIG. 4, illustrating the roller cutting into fresh wet concrete in a first pass.
Figure 6:
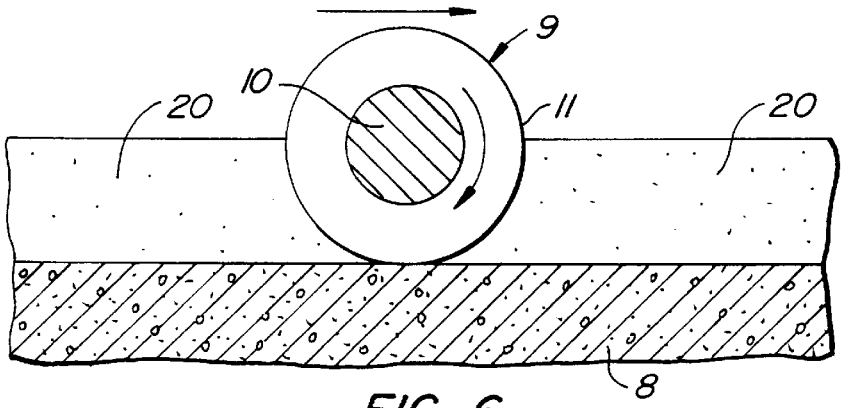
FIG. 6 is a cross sectional view of the system shown in FIG. 5 on a second pass in the opposite direction.

The manufacturing process is comprised of first setting up the casting forms 2 on the casting bed 1. Next, a form liner 5 is placed in each compartment 23 of the casting form 2. Next, rebar 19 is placed in each compartment 23. Then wet concrete 8 is poured into each compartment 23, and the surface smoothed and made to settle with a conventional vibrating screed machine (not shown). Then the roller 9 is positioned at one end of the casting form 2. As shown in FIGS. 3–5, the hydraulic machine 12 drives roller 9 in a forward direction. The roller surface has traction in the concrete and pulls the roller 9 through the wet concrete 8 cutting grooves 20. During this first pass, as shown in FIG. 4, workers hold the arms 16, 17 and slightly retard the forward progress of the roller 9, so that the roller 9 spins in the wet concrete 8. The combined forward movement and spinning of the roller 9 forces rocks in the concrete mixture out of the groove area, and tends to cut the wet concrete 8 to essentially full groove depth, as shown in FIG. 5. This first pass is completed in about 40 seconds, and is immediately followed by a second pass of similar duration in the opposite direction, with the direction of roller spin reversed, as shown in FIG. 6. Next, the concrete 8 is allowed to set for a short period of time, such as 15 to 20 minutes, until the concrete 8 has begun to harden but is not so hard that it cannot still be worked. During this time, first and second roller passes are made in each of the remaining compartments 23 of the casting form. The roller 9 is then returned to the first compartment for a third roller pass. This third pass is like the first and second passes, except that the concrete has partially slumped back into the grooves 20. Workers retard roller progress even more than in the first and second passes so that the third pass takes about twice as long as the first pass. During this slow third pass, the roller restores the form of the groove 20 and the spinning action of the roller smooths the concrete surface. This third pass is then repeated in the other casting compartments and all concrete panels are allowed to harden. Once the concrete 8 has hardened sufficiently, the forms 2 are disassembled and the finished panels 21 are removed from the casting bed 1. As shown in FIG. 7, the finished panels 21 have grooves on their front and back surfaces. The depths of grooves formed on the topside of the panel by the roller system of the present invention are equal to the difference between the diameters of the roller shaft 10 and wheels 11.

Figure 8A:
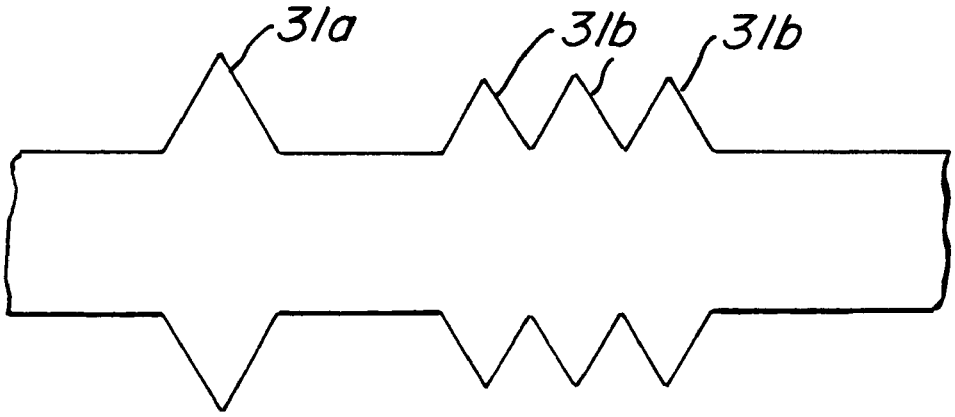
FIGS. 8*a* and 8*b* show alternate forming surface configurations according to the present invention.
Figure 8B:
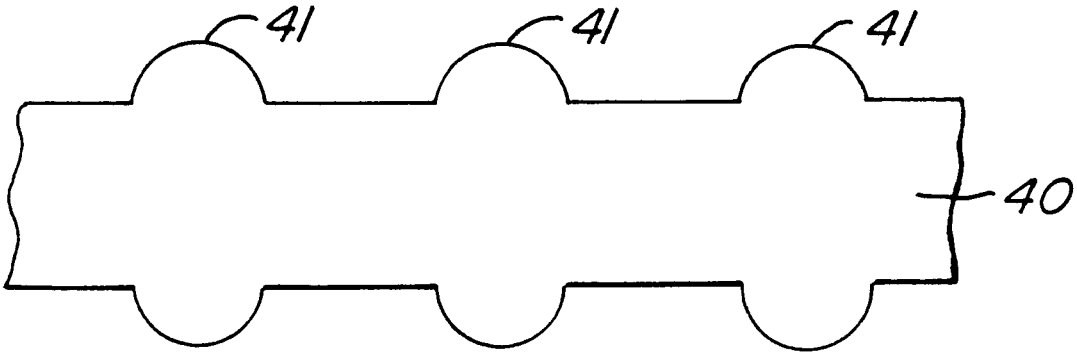

The forming roller 9 may be provided with different forming surface configurations to form different patterns in the concrete surface. For example, as shown in FIG. 8*a*, the roller 30 has multiple triangular ridges 31*a*, 31*b* of variable height, and variable spacing between the ridges. As shown in FIG. 8*b*, the roller 40 has multiple rounded ridges 41 with uniform height and uniform spacing between the ridges.

It will be appreciated by persons skilled in the art that variations may be made in both the apparatus and manufacturing process described herein without departing from the invention. Thus, the roller may be used to provide a wide variety of surface patterns by varying the size, shape, spacing and height of the roller's forming ridges. Moreover, the numbers of passes made with the roller, the speed of the roller, and the time taken to make any single pass can vary depending upon the concrete mixture and the climate where manufacturing takes place. Further, other mechanisms may be employed to impart rotation to the roller.

What is claimed is:

1. A method of manufacturing patterned precast concrete panels comprising:

a. pouring wet concrete into a casting form having elongate side rails;

b. supporting an elongate roller having a shaped forming surface on said side rails of the casting form;

c. driving the elongate roller across a surface of the wet concrete by rotating the elongate roller in a forward direction while simultaneously partially retarding progress of the elongate roller along the surface of the wet concrete so that the elongate roller spins in the wet concrete to shape and smooth the concrete surface.

2. The method of claim 1 wherein the elongate roller is driven across the surface of the wet concrete at least once while the wet concrete is relatively liquid, and again after a delay during which the concrete has been allowed to partially harden.

3. The method of claim 1 wherein the step of driving the elongate roller across the wet concrete surface is carried out multiple times, interrupted by a delay period during which time the concrete is allowed to partially harden.

4. The method of claim 3 wherein the delay period is at least about 15 minutes.

5. The method of claim 2 wherein the step of driving the elongate roller across the concrete surface after a delay period during which the concrete is allowed to partially harden is carried out more slowly than during the roller driving step when the wet concrete is relatively liquid so that the wet concrete surface is subjected to longer spinning action after the delay than in the roller driving step when the wet concrete is relatively liquid.

* * * * *